United States Patent [19]

Anscomb

[11] Patent Number: 4,566,613

[45] Date of Patent: Jan. 28, 1986

[54] MULTIPLE OPENING STRUCTURE RECEPTACLE

[75] Inventor: Timothy Anscomb, Chailey, Nr. Lewes, England

[73] Assignee: Schering-Prebbles Limited, Bootle, United Kingdom

[21] Appl. No.: 519,960

[22] Filed: Aug. 3, 1983

[30] Foreign Application Priority Data

Aug. 3, 1982 [GB] United Kingdom ..... 8222426

[51] Int. Cl.[4] ..... B65D 47/10

[52] U.S. Cl. ..... 222/541; 215/32

[58] Field of Search ..... 222/541, 153, 420; 215/32, 34, 35, 31; 220/266, 265; 604/200, 212

[56] References Cited

U.S. PATENT DOCUMENTS

| | | | |
|---|---|---|---|
| 621,161 | 3/1899 | Shaw | 215/32 |
| 898,575 | 9/1908 | Graves | 215/35 |
| 2,952,861 | 9/1960 | Reggio | 222/541 |
| 3,124,280 | 3/1964 | Stall | 222/541 |
| 4,248,227 | 2/1981 | Thomas | 222/541 |
| 4,266,681 | 5/1981 | Fredericks | 215/32 |
| 4,284,213 | 8/1981 | Lee | 222/541 |
| 4,408,699 | 10/1983 | Stock | 222/541 |

*Primary Examiner*—Joseph J. Rolla
*Assistant Examiner*—Kenneth Noland
*Attorney, Agent, or Firm*—Millen & White

[57] ABSTRACT

A receptacle includes a main body portion and a tapered neck portion. The receptacle tapered neck portion includes multiple opening points, preferably one at the tip end and one at the base near the main body portion. By selectively opening at one of the opening points, either drop-by-drop or general large-scale topical administration can be provided.

24 Claims, 6 Drawing Figures

MULTIPLE OPENING STRUCTURE RECEPTACLE

CROSS-REFERENCE TO CO-PENDING U.S. PATENT APPLICATIONS

This application is co-pending with U.S. design application Ser. No. 463,424 which was filed Feb. 3, 1983.

BACKGROUND OF THE INVENTION

This invention relates to hand-held receptacles especially for use in containing medical and veterinary liquids, and more particularly, to the means by which the contents thereof are to be discharged.

There are many prior art container structures designed to allow storage, ease of handling and ease of discharge of pourable contents. Among these are containers, for example, having detachable caps over an opening, and closable openings or hinged covers or spouts within the caps through which the container contents may be forced or poured out.

In the medical field, there are a vast number of container structures for the storage and application of medicinal liquids, creams, and the like. Many of these medical liquid containers must be capable of storing sterilized fluids without permitting seepage or the introduction of foreign, non-sterile matter into the container. This is particularly important for the storage of infusion and injection solutions, and for the storage of solutions to be applied to delicate or sensitive regions of the body, for example, to the eye.

Typically, in the medical and veterinary professions it is common practice to employ pre-sterilized vials or bottles having ends adapted for being broken off to allow removal of the contents from a storage area. Examples are containers having a special closure whereby the insertion of a needle of an injection syringe through the closure permits removal of the contents. This allows injection of a sterilized liquid using a sterilized syringe without the sterilized liquid coming into full contact with the atmosphere before administration to the patient.

Other types of containers in widespread use in both of the above-discussed professions are dropper bottles for the topical administration of a sterilized fluid to a specific area of treatment. These dropper bottles are adapted for use either on a small scale, for example, for application to the eye, ear or nose, or on a large scale for application to larger affected areas of skin. Such bottles are usually shaped in the form of a reservoir having a dropper attachment. The dropper is typically shaped as a small open-end tube having a narrow bore through which are released the contents of the container in drops upon squeezing of the reservoir area. Dropper receptacles are also provided in the form of a separate dropper tube adapted for screwing onto the receptacle to also serve the function of closing or sealing the receptacle.

Many medical and veterinary fluids presently in use are suitable for use in different types of treatments. More particularly, it has often been found that some medical fluids which are suitable for the treatment of small areas or regions such as the eye, ear or nose, are also suitable for use in large scale topical treatment of other areas of the skin. Such fluids are often packaged in different types of containers, for example, the fluid for use on a small scale is packaged in dropper bottles, and the fluid for use on a large scale is packaged in screw-capped bottles. It is also often the case that fluid for use in treatment of the same area of the body is contained in different types of receptacles. For example, two different container types for similar use are dropper bottles for aplying drops of fluid to the eye, and screw-capped bottles for using the fluid as an eye wash.

Thus, the prior art includes the disadvantage that numerous different types of containers or receptacles are required, even when only one type of liquid or content is to be stored, depending on the use to which such contents are to be applied.

SUMMARY OF THE INVENTION

It is thus an object of the present invention to provide a new and improved container adapted for multiple uses.

It is another object of the invention to provide a container of the above-type adapted for application of its contents both on a small scale, as well as on a large scale.

Upon further study of the specification and appended claims, further objects and advantages of this invention will become apparent to those skilled in the art.

The container of the invention is a dual-purpose receptacle or container constructed to release, selectively, either small or large quantities of its contents.

The device of the present invention comprises a receptacle adapted for being hand-held and for dispensing fluid contents, and including a main storage portion and a generally tapered end portion through which the contents thereof may be discharged. The tapered end portion is constructed as a dual-opening structure to provide two different types of openings. A first pre-defined breaking point is situated toward the tip of the tapered end portion and a second pre-defined breaking point is situated toward the base of the tapered end portion proximate the main storage portion such that the user has the option of releasing the contents by the application of a twisting or snapping motion to the first breaking point sufficient to break or rupture the seal, or by the application of pressure to the second breaking point, whichever type of opening is desired.

In an alternative construction, the pre-defined breaking points can be made recloseable. For instance, a plug type closure or a small cylinder can be provided to cover one or another of the two break points.

The receptacles of the invention find special use in the medical or veterinary fields for use as dual-purpose applicators. The receptacle may contain a pourable medium therein, for example, a lyophilized powder. However, it is preferably adapted to contain a sterilized fluid or liquid and is itself, with its contents, of a material capable of withstanding sterilization. Sterilization can be by autoclave, radiation or other conventional techniques as will be apparent to those of ordinary skill in the art. The materials need merely be capable of resisting sterilization by the means selected. Thus, contents of the receptacle will need to be assessed on a case by case basis to determine which type of sterilization to employ. For instance, Chlorhexidine will not stand up to irradiation.

The receptacle of the invention functions as a dual purpose container capable of releasing small quantities of the contents when the first breaking point is ruptured, or of releasing larger quantities of the contents when the second breaking point is ruptured. It is also possible to construct the first breaking point so that it can be ruptured by a syringe needle and the contents can be withdrawn by use of the syringe.

In another embodiment, the tapered end portion of the receptacle of the invention functions as a dropper applicator when the first breaking point is ruptured. It is appropriate in such cases that the first breaking point is constructed as a "twist-off" constriction, especially a flat, twist-off constriction, adjacent the tip of the tapered end portion. Such a structural arrangement may be designed in a pre-defined region of the first breaking point by incorporating a preformed area of weakness leaving a marginal indentation to permit an easy and clean break at that point. The "dropper" section of the tapered end portion is rounded off at the constriction to provide the dropper action and to eliminate the possibility of sharp edges at the end of the dropper applicator forming, as will be apparent to those of ordinary skill in this art. By additionally providing a flattened tip region, grasping and breaking at the first breaking point is facilitated.

If desired, larger quantities of liquids may be released by detaching a larger section of the tapered end portion by rupturing at the second breaking point, preferably by breaking-off in a lever-like motion, the tapered portion above the second breaking point. For this purpose it is preferred that the tapered portion be inclined at an angle with respect to the main storage portion of preferably about 65°. This facilitates grasping and breaking in the lever-like motion, and in addition, provides a comfortable fit into the hand of a user and facilitates control when the first break point is snapped off thereby facilitating drop by drop administration. It is also preferred, in such cases, that the second breaking point be covered by a flexible, plastic diaphragm or membrane extending between the main body portion of the receptacle and the section to be detached. The membrane or diaphragm is an integral part of the container and is thus in one embodiment, made up of polypropylene. In the event the receptacle is made of, e.g., high density polyethylene, then the membrane or diaphragm would also be made of that material. This provides a flexible joint on the outside of the container and the flexibility of such a joint serves to prevent accidental breakage at this point in the event the receptacle is knocked over or jarred. The second breaking point is arranged under the diaphragm and may be formed underneath this diaphragm or membrane in the same manner as the first breaking point so that upon application of pressure to the point, the receptacle under the diaphragm as well as the diaphragm break apart from the remaining portion of the receptacle with a clean break. If desired, the diaphragm section can have a reinforced lower section which engages in a snap-fit type action or over a smooth-rimmed opening or groove encircling the top of the main body portion. In any event, the diaphragm is not an added item, but is formed as part of the moulding process or manufacture.

The receptacle of the invention is appropriately constructed to contain a unit dose of a sterilized material. In such a form the receptacle can be used to provide a single dose of sterilized material as the need arises without wasting material. This is of importance in various retail and hospital uses. The receptacle of the invention, for example, may contain a unit dose of sterilized lubricating jelly for use, immediately before or during operations, for the lubrication and sterilization of surgeon's gloves, or hospital equipment such as catheters.

The receptacle of the invention may also be employed in a factory or engineering workshop environment to contain a unit dose of, for example, eye wash fluid for use in emergencies. A receptacle containing 200 ml of the fluid would, for example, satisfy the requirements of present day legislation covering health and safety at place of work. The shape of the receptacle would be of particular assistance in such emergency use, as it provides rapid access to the sterile content which may either by administered dropwise or as a jet by pouring, depending on the size of the affected area or the need for removal of foreign bodies, e.g., from the eye, dependent on the break point chosen. The shape of the receptacle allows great precision in administration.

The receptacle of the invention finds special use as a dual purpose dropper applicator and a topical applicator permitting either administration of drops for treatment or the pouring of treatment fluid for topical administration without the requirement of having two containers. Preferably, the receptacle of the invention finds use as a dual purpose eye dropper and container of eye wash fluid. In such cases, the storage area should be of a size such as to accommodate in the range of 15 to 20 ml of fluid at least, and preferably 20 ml of fluid. The storage portion of the receptacle is contoured to a shape allowing easy handling and use for both purposes.

In addition, the receptacle of the invention can be made of materials such as glass or, preferably, a flexible plastic material, e.g., polypropylene. Polypropylene is particularly useful where the receptacle is to be sterilized in a sterilization chamber such as an autoclave by superheated steam. Other conventional sterilization chambers include a radiation chamber for conducting sterilization by radiation. Polyethylene may also be used as the component material but only where sterilization in an autoclave is not to be conducted. In this case, provided the fluid contained will stand up to it (most inorganic substances will, whilst most long chain organics should be suspected), then gamma radiation should be employed. The flexible plastic material is especially useful where the receptacle functions as an eyedropper since the storage area may then be squeezed to aid in the release of the drops. The body of the receptacle may be clear or opaque, preferably clear, to allow a visual check of the amount of fluid in the storage area. The condition of the fluid, which may change in color upon exposure to air, for example, may also be inspected in this manner.

Typically, the receptacle will have a wall thickness of approximately one thirty secondth of an inch, this thickness being required to ensure rigidity and conformability of the pack while being sufficiently flexible to allow discharge of the contents in the dropwise mode. The container is made entirely of polypropylene or polyethylene and no other materials are needed in its manufacture.

In this case where the receptacle is made of plastic, it may be manufactured by known conventional plastic molding techniques. For example, a receptable of polypropylene may be manufactured by melting granules of polypropylene, blow-molding the polypropylene into the desired shape, filling the receptacle with the sterilized contents, and sealing the receptacle in one multistep operation. The container could also be made by injection molding but then a separate filling and final sealing line would be required.

BRIEF DESCRIPTION OF THE DRAWINGS

Various other objects, features and attendant advantages of the present invention will be more fully appreciated as the same becomes better understood when considered in conjunction with the accompanying drawings wherein.

DETAILED DISCUSSION OF THE INVENTION

Figure 1:
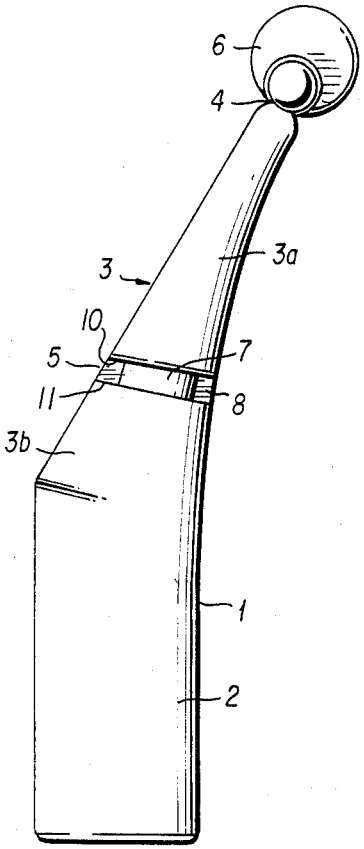
FIG. 1 is a side view of the receptacle of the invention.
Figure 2:
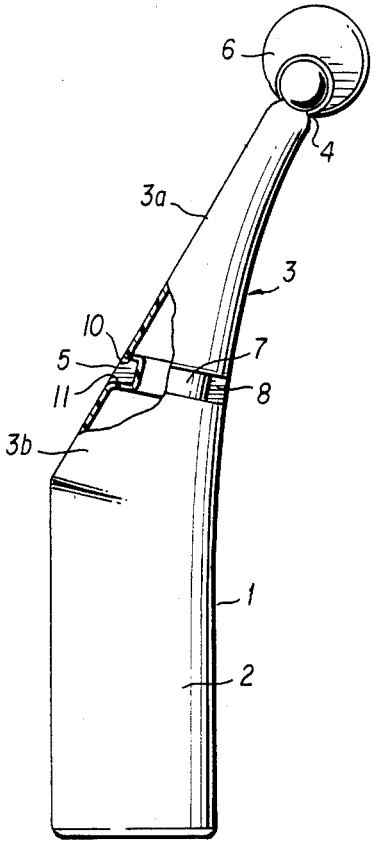
FIG. 2 is a side view of the receptacle of the invention in a partial, cut-away view at the second breaking point.
Figure 3:
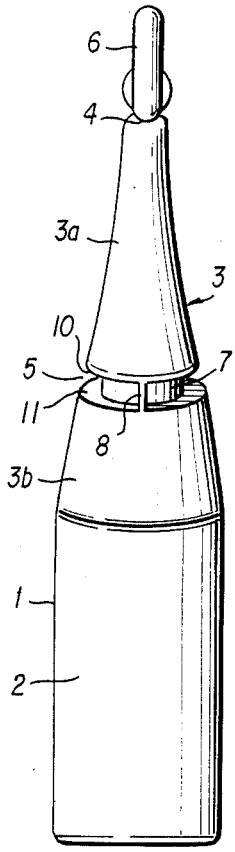
FIG. 3 is a rear view of the receptacle.

With reference to FIGS. 1 and 3, receptacle 1 is shown having a generally cylindrically shaped storage area 2 and a generally gradually and continuously tapered end portion 3 which is inclined from the base portion 2 at an angle preferably of approximately 65°. More particularly, the angle is such taht when the body is held in the hand, the neck is conveniently placed to allow precise administration of the fluid contained therein. 65° has been found to be a convenient angle. The tapered portion has two pre-defined breaking points, a first breaking point 4 at the tip of the tapered portion and a second breaking point 5 between an upper tapered portion 3*a* and a lower tapered portion 3*b*. By adaptation of the molds, other breaking points could be embodied should specific requirements for them in terms of flow rate prove desirable. Equally, the dropper end of the receptacle could be adapted in such a way that when it is opened, it would accept a luer catheter connection. The second breaking point should be at the end of the neck section and be at a point no more than 70% of the distance from the base of the receptacle. The tip of the tapered portion includes a flattened section 6 or projection to aid in removal at the first breaking point by facilitating a twisting or snapping motion about the tip of breaking point 4.

The second breaking point includes a pre-defined breaking or levering point in the form of a narrowing of the tapered portion to form a neck 7 in the tapered portion. The neck 7 is constructed as a preformed area of weakness which allows an easy and clean break at that point by the application of pressure to the upper tapered portion 3*a* above the neck 7. At the neck a diaphragm or membrane 8 serves as a web to strengthen the connection of the tapered portion 3*a* to the lower tapered portion and to the storage area 2 to prevent accidental rupturing at the neck, for example, in the event the receptacle 1 is accidentally knocked over. Preferably, there are two webs 8 spaced apart by the wall forming the neck 7. The webs 8 adjoin the wall of the neck 7 and opposed surfaces 10 and 11 on the upper tapered portion 3*a* and lower tapered portion 3*b*, respectively.

As previously discussed, the receptacle may be constructed of a flexible plastic material, e.g., polyethylene or polypropylene, and may contain unit dose amounts of lyophilized contents, or, for example, 20 ml–200 ml of fluid contents. The plastic materials from which the receptacle is formed permit affixing of identification marks thereon and use-by date identification to be incorporated into the receptacle upon manufacture. This information can also, for example, be applied by using self-adhering labels in the event other materials such as glass are used to make the receptacle.

In use, the receptacle can be opened by twisting-off or snapping-off the flattened section 6 to permit its use as a drop-by-drop dispensing bottle, or a breaking off the upper tapered portion to permit discharge of the contents by a simple pouring motion.

Figure 4:
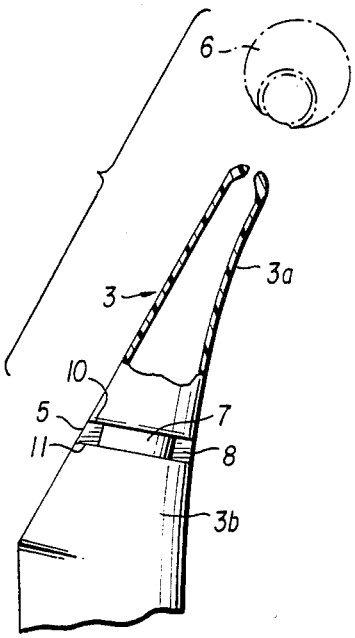
FIG. 4 is an enlarged side cross-sectional view of the first breaking point.

Referring to FIG. 4, it is seen that when the flat closure at the extreme tip of the neck section is snapped off, it leaves a slight depression in the neck section thus protecting delicate organs such as the eye from damage occurring from sharp pieces of polypropylene flashing. Opening at this point gives drops or a jet dependent on the pressure exerted by finger and thumb on the body section.

Figure 5A:
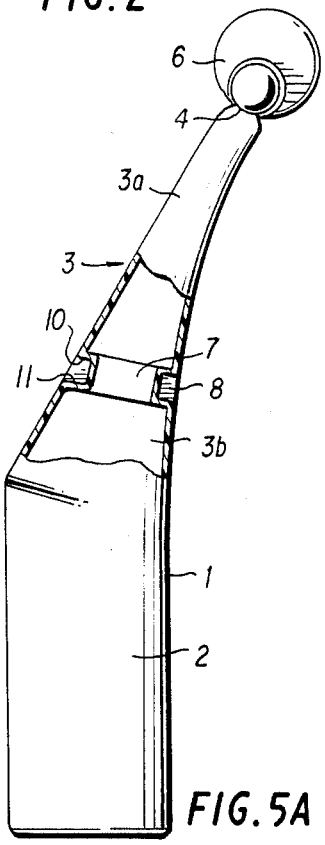
FIG. 5A is a side view of the receptacle unopened.
Figure 5B:
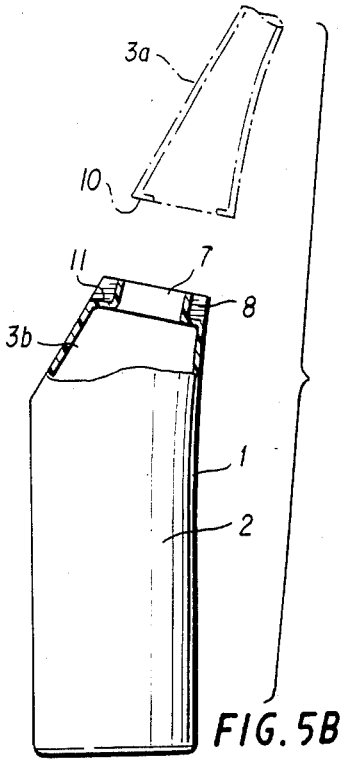
FIG. 5B is a view as in FIG. 5A showing the receptacle opened at the second breaking point.

Referring now to the second break point C, this is shown in FIGS. 5A and 5B. When it is desired to open the receptacle at the second break point, the neck section A is levered backwards with the thumb while holding the body section B in the fingers. The diaphragm then breaks and the container is opened with a large orifice suitable for pouring.

Without further elaboration, it is believed that one skilled in the art can, using the preceding description, utilize the present invention to its fullest extent.

What is claimed is:

1. A hand-held receptacle for storing pourable contents comprising:

(a) receptacle storage means comprising a storage portion and a generally tapered end portion through which contents stored therein may be discharged, the generally tapered end portion having a top and a base;

(b) dual opening means arranged on said generally tapered end portion, said dual opening means being comprised of a first pre-defined breaking point situated toward the top of the tapered end portion, and a second pre-defined breaking point situated toward the base of the tapered end portion, said second pre-defined breaking point being located proximate said storage portion, said first and second breaking points providing a user with the option of releasing the contents by the application of a twisting or snapping motion to said first breaking point, or by the application of pressure to the second breaking point to break open the receptacle at one of the breaking points as desired;

(c) said second breaking point being an abrupt neck portion of a small diameter than the tapered end portion said abrupt neck portion having a wall extending between a pair of opposed surfaces on the tapered end portion, said opposed surfaces extending radially with respect to the axis of the tapered portion; and (d) spaced web members adjoining both the wall of the neck portion and the opposed surfaces for strengthening the neck portion and determining the direction of breakage of the neck portion.

2. A receptacle as in claim 1, wherein said tapered end portion is constructed for medical or veterinary use as an applicator having a dual-opening structure.

3. A receptacle as claimed in claim 2, having a sterilized fluid contained therein, and wherein said receptacle with its contents is adapted for withstanding sterilization.

4. A receptacle as in claim 2, wherein said tapered end portion is constructed to function as a dropper application upon rupturing of said the first breaking point.

5. A receptacle as in claim 2, constructed so that a substantially large section of said tapered end portion can be detached by breaking off the section at said second breaking point.

6. A receptacle as claimed in claim 1, having a sterilized fluid contained therein, and wherein said receptacle with its contents is adapted for withstanding sterilization.

7. A receptacle as in claim 6, wherein said tapered end portion is constructed to function as a dropper applicator upon rupturing of said first breaking point.

8. A receptacle as in claim 1, wherein said tapered end portion is constructed to function as a dropper applicator upon rupturing of said first breaking point.

9. A receptacle as in claim 8, wherein said first breaking point is a constricted portion adjacent the tip of said tapered end portion.

10. A receptacle as in claim 9, wherein the tip of said tapered end portion is flattened to facilitate breaking at said first breaking point by twisting of the flattened tip.

11. A receptacle as in claim 8, wherein the tip of said tapered end portion is flattened to facilitate breaking at said first breaking point by twisting or snapping of the flattened tip.

12. A receptacle as in claim 11, constructed so that a substantially large section of said tapered end portion can be detached by breaking off the section at said second breaking point.

13. A receptacle as in claim 8, constructed so that a substantially large section of said tapered end portion can be detached by breaking off the section at said second breaking point.

14. A receptacle as in claim 1, constructed so that a substantially large section of said tapered end portion can be detached by breaking off the section at said second breaking point.

15. A receptacle as in claim 1, containing a unit dose of contents.

16. A receptacle as in claim 15, which is of a size capable of containing 15 to 20 ml of fluid.

17. A receptacle as claimed in claim 15, which is of a size capable of containing up to 200 ml of fluid.

18. A receptacle as in claim 15, containing eye treatment fluid therein.

19. A receptacle as in claim 1, containing eye treatment fluid therein.

20. The receptacle of claim 1 wherein the axis of the tapered end portion extends at an angle of tilt of approximately 65 degrees with respect to the extent of the storage portion and wherein the web portions are in the plane which includes the angle of tilt.

21. The receptacle of claim 1 wherein the top of the receptacle is flattened to have generally parallel sides which extend in the direction of said plane.

22. The receptacle of claim 1 wherein the web is made of flexible plastic material.

23. The receptacle of claim 1 wherein the receptacle storage means is made of flexible plastic material.

24. The receptacle of claim 23 wherein the plastic material is selected from the group consisting of polyethylene and polypropylene.

* * * * *